United States Patent [19]

Messina et al.

[11] Patent Number: 4,465,278

[45] Date of Patent: Aug. 14, 1984

[54] NUMBER SELECTING GAME DEVICE

[76] Inventors: Samuel V. Messina, 926 Broadhead Rd.; Kevin F. Rose, 14 Eichelberger Dr., both of Coraopolis, Pa. 15108

[21] Appl. No.: 462,306

[22] Filed: Jan. 31, 1983

[51] Int. Cl.[3] ..... A63F 7/04

[52] U.S. Cl. ..... 273/144 B

[58] Field of Search ..... 273/144 B, 144 A, 144 R, 273/138 R, 161, 145 C, 145 CA, 145 D, 145 E

[56] References Cited

U.S. PATENT DOCUMENTS

| | | | |
|---|---|---|---|
| 4,368,887 | 1/1983 | Gamble | 273/144 B |
| 4,403,775 | 9/1983 | Chaput | 273/144 B |

FOREIGN PATENT DOCUMENTS

| | | | |
|---|---|---|---|
| 555635 | 7/1932 | Fed. Rep. of Germany | 273/144 B |
| 1030506 | 3/1953 | France | 273/144 B |

*Primary Examiner*—Paul E. Shapiro

*Attorney, Agent, or Firm*—William J. Ruano

[57] ABSTRACT

A game device which enables random selection of a three digit or four digit number for the purpose of playing a lottery or other game. It comprises a transparent plastic case having a hopper portion where various balls of different colors are mixed at random such as by shaking the device, when inverted, and allowing the balls to fall by gravity into four chutes or possibly three chutes. In some instances, three chutes may appear on one side of the device and four on the other to enable selective play of either three or four numbers. By coloring the plastic container the same color as most of the balls, such balls will not be readily visible exteriorly of the device. However the other balls which are numbered and of a different color, such as white, will appear visible and when read from top to bottom in the chutes will reveal three numbers or four numbers, as desired, which can be used for any desired purpose, such as for playing a lottery.

3 Claims, 5 Drawing Figures

NUMBER SELECTING GAME DEVICE

This invention relates to a game device for selecting two, three, four, or more numbers for any desired purpose, such as for playing a lottery.

In the past, great interest has been shown in the random selection of hopefully lucky numbers for playing a lottery or other game. Books have been printed with numbers listed indicated as being possibly lucky. Some persons have used their phone numbers or addresses for this purpose.

An object of the present invention is to overcome the disadvantages of buying so-called lucky numbering from time to time and instead, obtaining such numbers by a chance selection from a device embodying the present invention.

A more specific object of the present invention is to provide a novel device for readily and quickly selecting, at random, a double number, a triple number, a quadruple number or the like.

Other objects and advantages of the invention will become more apparent from the drawing taken with the accompanying description wherein.

Figure 1:
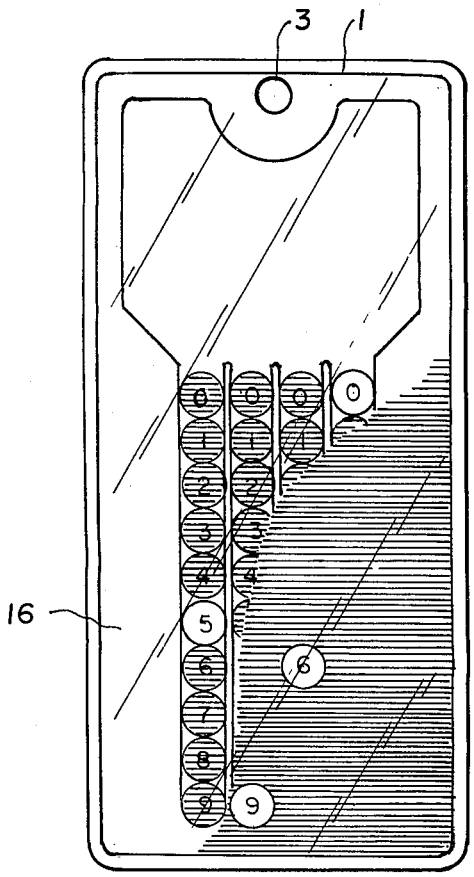
FIG. 1 is a plan view of a game device for randomly selecting three or four numbers as desired, although it should be understood that even a single number or one greater then four may be selected instead.
Figure 4:
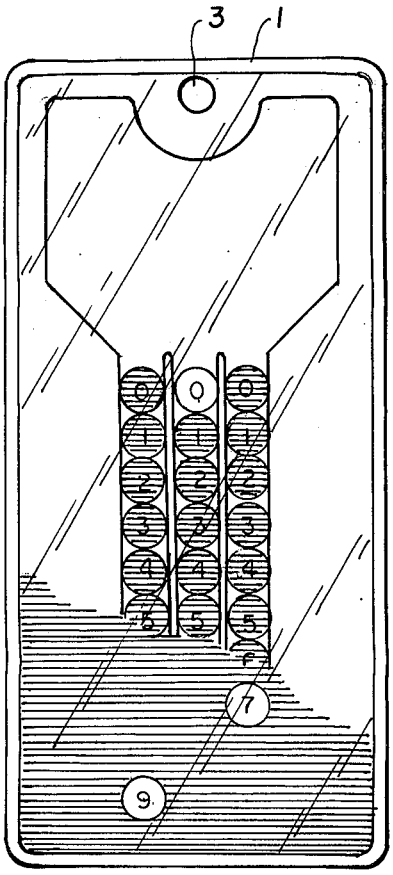
FIG. 3 is a side elevational view and FIG. 4 is a plan view of the rear of the device shown in FIG. 1.

Referring more particulrly to FIG. 1 of the drawing, numeral 1 generally denotes a substantially rectangular casing of transparent plastic material representing one half of the device made up of symmetrical halves having attached thereto a carrying chain (not shown) through a grommet 3. Centrally of the case there are four vertical columns for receiving balls. The two symmetrical halves, each of the construction shown are attached together by ultrasonic welding of the beads 1*a*. Part 1*b* is recessed to prevent burning from the weld. Above the columns is a reservoir and chute for storing and mixing a plurality of balls, such as green balls and white balls. The white balls correspond in number to the number of digits of the number one desires to randomly select, for the purpose of playing a lottery or for any other purpose. There are at least as many vertical columns as the number of digits as in the total of the number selected. In some cases there are more white balls than there are columns in which case any two white balls appearing in the same vertical column would be read in succession from top to bottom. Numbers are imprinted on the front and back of the device (FIGS. 1 and 4) on the respective columns starting from No. 1 on the top of the left column and increasing numerically in a downward direction to No. 9 and continuing from the top of the next adjacent column until all four columns are numbered throughout their heigh.

Figure 2:
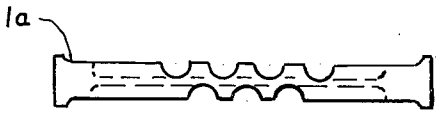
FIG. 2 is an enlarged side elevational view showing the internal partition portions for providing four vertical columns or chutes.
Figure 3:
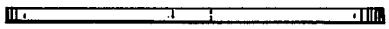
Figure 5:
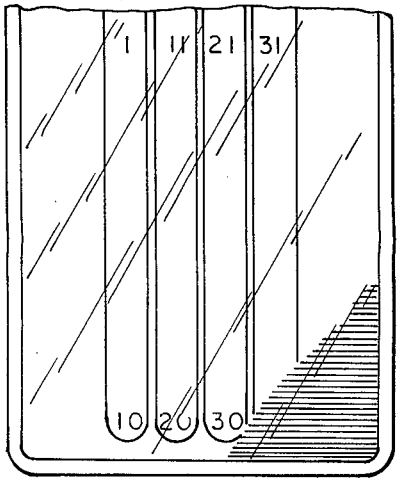
FIG. 5 shows a half view of the device with different number and with the back cover cut away.

In operation, the device shown in FIG. 1 is inverted and shaken so that the balls will be thoroughly mixed in the reservoir. Upon inverting again, the balls will fall through the chute into the respective columns formed by the partitions shown in FIGS. 1 and 2.

If only a three digit number is desired, the structure shown may still be used or perhaps one having three instead of four vertical columns. In some cases it is desirable to have both the four digit construction of FIGS. 1 and 2 and the three digit construction described in the same device. This can be accomplished by having a three column device attached back-to-back to a four column device by ultrasonic welding of parts 1*c*.

While the color green has been indicated as the one for coloring the balls as well as the walls or cover of the gaming device so that the balls will not be seen, other colors may be selected instead, the only requirement being that the white balls (or other colored balls that are to be read) will be visible since they do not correspond in color to that of the casing of the device. By denoting the number adjacent each white ball, the total of the white numbers is noted as the lucky number to be played in the lottery. Of course, the white balls themselves may bear numbers. Thus it will be seen that I have provided a relatively inexpensive and highly efficient gaming device for randomly selecting three or four numbers for the purpose of playing a lottery or for any other purpose; also I have provided a device which may be made of a construction to enable the selection of either a three number total or a four number total depending upon which side of the device is used.

While I have illustrated and described several embodiments of my invention, it will be understood that these are by way of illustration only and that various changes and modifications may be contemplated in my invention and within the scope of the following claims:

I claim:

1. A device for randomly selecting a number having a plurality of digits, comprising a casing of transparent plastic material of a given color and including a reservoir and chute terminating in a plurality of parallel vertical columns formed by partitions in said device, a plurality of balls in said casing, most of said balls being of the same color of said given color so as not to be readily visible, the remaining balls being of a different color that is visible from the exterior of said casing.

2. A device as recited in claim 1 having on one side, partitions for allowing the balls to fall into three vertical columns, and having, on the opposite side, partitions for separating the balls into four vertical parallel contiguous columns for receiving said balls after being agitated in said reservoir.

3. A device as recited in claim 1 in which numbers in succession appear on each of said vertical columns which are imprinted on the outside of the device.

* * * * *